US011735876B2

(12) United States Patent
Hanson et al.

(10) Patent No.: US 11,735,876 B2
(45) **Date of Patent: *Aug. 22, 2023**

(54) DISTAL CONNECTOR ASSEMBLIES FOR MEDICAL LEAD EXTENSIONS

(71) Applicant: MEDTRONIC, INC., Minneapolis, MN (US)

(72) Inventors: Scott M. Hanson, Savage, MN (US); Joseph P. Ricci, Ham Lake, MN (US); Adam J. Rivard, Blaine, MN (US); Jonathan C. Sell, Eagan, MN (US)

(73) Assignee: MEDTRONIC, INC., Minneapolis, MN (US)

( * ) Notice: Subject to any disclaimer, the term of this patent is extended or adjusted under 35 U.S.C. 154(b) by 192 days.

This patent is subject to a terminal disclaimer.

(21) Appl. No.: 17/129,773

(22) Filed: Dec. 21, 2020

(65) Prior Publication Data

US 2021/0111525 A1 Apr. 15, 2021

Related U.S. Application Data

(63) Continuation of application No. 16/284,851, filed on Feb. 25, 2019, now Pat. No. 10,886,677, which is a continuation of application No. 15/894,912, filed on Feb. 12, 2018, now Pat. No. 10,218,133, which is a continuation of application No. 15/295,744, filed on Oct. 17, 2016, now Pat. No. 9,899,778, which is a continuation of application No. 14/179,650, filed on Feb. 13, 2014, now Pat. No. 9,472,916.

(60) Provisional application No. 61/781,694, filed on Mar. 14, 2013.

(51) Int. Cl.

| | |
|---|---|
| ***H01R 13/64*** | (2006.01) |
| ***H01R 24/58*** | (2011.01) |
| ***H01R 43/20*** | (2006.01) |
| *H01R 107/00* | (2006.01) |

(52) U.S. Cl.

CPC ..... *H01R 24/58* (2013.01); *H01R 43/20* (2013.01); *H01R 2107/00* (2013.01); *H01R 2201/12* (2013.01); *Y10T 29/4922* (2015.01)

(58) Field of Classification Search

CPC ..... A24F 47/00; H01R 4/20; H01R 24/56

USPC ..... 131/328–329; 439/668, 669; 607/37, 36

See application file for complete search history.

(56) References Cited

U.S. PATENT DOCUMENTS

| | | | |
|---|---|---|---|
| 3,789,344 | A | 1/1974 | Brorein |
| 4,603,696 | A | 8/1986 | Cross |
| 4,898,173 | A | 2/1990 | Daglow |

(Continued)

*Primary Examiner* — Phuong K Dinh

(74) *Attorney, Agent, or Firm* — Withers & Keys, LLC

(57) ABSTRACT

Distal connector assemblies that are on the distal end of medical lead extensions provide increased rigidity by including a rigid holder that contains the electrical connectors. The electrical connectors are separated within the rigid holder by insulative spacers that may be individual items or may be formed from a compliant carrier that the electrical connectors may reside within where the carrier is positioned within the rigid holder. The rigid holder may also contain a set screw block defining set screw bore or the rigid holder may include an integral portion that defines a set screw bore. The integral portion may include a slot to allow a molding pin loaded with the electrical connectors and other components to be dropped into a cavity of the rigid holder. An overmold may be present to surround the rigid body containing the electrical connectors and insulative spacers.

29 Claims, 16 Drawing Sheets

(56) References Cited

U.S. PATENT DOCUMENTS

| | | | | |
|---|---|---|---|---|
| 5,000,177 | A | 3/1991 | Hoffmann | |
| 5,782,841 | A | 7/1998 | Ritz et al. | |
| 6,605,094 | B1 | 8/2003 | Mann et al. | |
| 6,755,694 | B2 | 6/2004 | Ries | |
| 6,895,276 | B2 * | 5/2005 | Kast | H01R 24/58 607/37 |
| 6,980,863 | B2 | 12/2005 | van Venrooij | |
| 7,047,077 | B2 | 5/2006 | Hansen | |
| 7,175,482 | B2 | 2/2007 | Zart | |
| 7,195,523 | B2 | 3/2007 | Naviaux | |
| 7,225,034 | B2 | 5/2007 | Ries | |
| 7,299,095 | B1 | 11/2007 | Barlow | |
| 7,326,088 | B2 | 2/2008 | Tulkki | |
| 7,422,487 | B2 | 9/2008 | Osypka | |
| 7,526,339 | B2 | 4/2009 | Lahti | |
| 7,654,843 | B2 | 2/2010 | Olson | |
| 7,904,161 | B2 | 3/2011 | Osypka | |
| 8,046,074 | B2 | 10/2011 | Barker | |
| 8,328,587 | B2 * | 12/2012 | Dilmaghanian | H01R 24/58 439/827 |
| 8,355,787 | B2 | 1/2013 | Barker et al. | |
| 8,437,855 | B2 | 5/2013 | Sjostedt | |
| 8,600,507 | B2 | 12/2013 | Brase | |
| 8,666,494 | B2 | 3/2014 | Schramm | |
| 8,690,609 | B2 | 4/2014 | Poon | |
| 9,162,055 | B2 | 10/2015 | Pianca | |
| 9,284,970 | B2 | 3/2016 | Dilmaghanian | |
| 9,466,915 | B2 | 10/2016 | Dilmaghanian | |
| 9,472,916 | B2 | 10/2016 | Hanson | |
| 9,899,778 | B2 | 2/2018 | Hanson | |
| 10,218,133 | B2 | 2/2019 | Hanson | |
| 10,886,677 | B2 * | 1/2021 | Hanson | H01R 43/20 |
| 2009/0030426 | A1 | 1/2009 | Zinn et al. | |
| 2012/0016377 | A1 | 1/2012 | Geroy | |
| 2012/0059321 | A1 | 3/2012 | Hammond et al. | |
| 2012/0083794 | A1 | 4/2012 | Martin et al. | |
| 2012/0191106 | A1 | 7/2012 | Ko et al. | |
| 2014/0273623 | A1 | 9/2014 | Hanson | |

* cited by examiner

DISTAL CONNECTOR ASSEMBLIES FOR MEDICAL LEAD EXTENSIONS

TECHNICAL FIELD

Embodiments are related to implantable medical lead extensions. More particularly, embodiments are related to distal connector assemblies and related methods.

BACKGROUND

Some patients are candidates for stimulation therapy such as for sacral nerve stimulation or spinal cord stimulation therapy to treat issues such as incontinence, chronic pain, or related conditions. A stimulation device provides the stimulation therapy via an implantable medical lead that has a distal end at a stimulation site within the body. It is often necessary to utilize an implantable medical lead extension in order to span the distance from a proximal end of the implantable medical lead to the location of the stimulation device, which may be an internal or external location depending upon the desired configuration of the therapy.

For instance, it may be desirable to conduct a trial period of stimulation. This trial period allows an external stimulator to be used so that the patient is not required to undergo a full stimulation device implantation procedure and to lessen the risk of infection. If the trial is successful, then an implantable stimulator is fully implanted into the patient. When implanting the trial system, an implantable medical lead is implanted with a distal end being routed to the stimulation site. An implantable lead extension is typically then routed subcutaneously from the location of the proximal end of the implanted medical lead to an exit site nearby the location where the external device will be mounted to the patient where a connection to an external stimulation device is made.

When connecting the proximal end of an implantable lead to the distal connector of a lead extension, the proximal end of the lead is inserted into a bore within the distal connector, and then a set screw is tightened to lock the proximal end within the bore. The distal connector is compliant, and therefore tightening the set screw tends to bend the distal connector, potentially causing damage to the connector or the proximal end of the implanted lead and/or causing improper electrical connectivity. Anatomical movements after the implant may also subject the distal connector to bending forces, which may also potentially cause similar damage and/or improper electrical connectivity.

SUMMARY

Embodiments address issues such as these and others by providing an implantable medical lead extension that includes a distal connector assembly having a rigid holder. The electrical connectors and intervening insulative spacers are seated within the rigid holder. A set screw block may either be seated within the rigid holder or may be an integral feature of the rigid holder. With a rigid holder configuration, when a set screw is being tightened, the rigid holder prevents bending of the distal connector of the lead extension.

Embodiments provide a medical lead extension that includes an elongated body and electrical connectors disposed in proximity to a proximal end of the elongated body. A plurality of conductors is within the elongated body and is electrically connected to corresponding electrical connectors. A distal connector assembly is coupled to the elongated body and includes a rigid holder having a plurality of features defining bays. A plurality of insulative spacers and electrical connectors are disposed within the rigid holder with the electrical connectors being separated by the insulative spacers, the electrical connectors being positioned in the bays and the insulative spacers being aligned with the features. The conductors are electrically connected to corresponding electrical connectors within the rigid holder, and an overmold surrounds the rigid holder and the plurality of spacers and electrical connectors.

Embodiments provide a medical lead extension that includes an elongated body and electrical connectors disposed in proximity to a proximal end of the elongated body. A plurality of conductors is within the elongated body and is electrically connected to corresponding electrical connectors. A distal connector assembly is coupled to the elongated body and includes a rigid holder. A plurality of insulative spacers and electrical connectors are disposed within the rigid holder with the electrical connectors being separated by the insulative spacers, and the plurality of insulative spacers are separate unitary bodies individually positioned within the rigid holder. The conductors are electrically connected to corresponding electrical connectors within the rigid holder, and an overmold surrounds the rigid holder and the plurality of spacers and electrical connectors.

Embodiments provide a medical lead extension that includes an elongated body and electrical connectors disposed in proximity to a proximal end of the elongated body. A plurality of conductors is within the elongated body and is electrically connected to corresponding electrical connectors. A distal connector assembly is coupled to the elongated body and includes a rigid holder. A plurality of insulative spacers and completely circular electrical connectors are disposed within the rigid holder with the electrical connectors being separated by the insulative spacers. The conductors are electrically connected to corresponding electrical connectors within the rigid holder, and an overmold surrounds the rigid holder and the plurality of spacers and electrical connectors.

Embodiments provide a medical lead extension that includes an elongated body and electrical connectors disposed in proximity to a proximal end of the elongated body. A plurality of conductors is within the elongated body and is electrically connected to corresponding electrical connectors. A distal connector assembly is coupled to the elongated body and includes a rigid holder that forms a semi-circular shape at a cross-section at an intermediate longitudinal location along the rigid holder. A plurality of insulative spacers and electrical connectors are disposed within the rigid holder with the electrical connectors being separated by the insulative spacers. The conductors are electrically connected to corresponding electrical connectors within the rigid holder, and an overmold surrounds the rigid holder and the plurality of spacers and electrical connectors.

Embodiments provide a medical lead extension that includes an elongated body and electrical connectors disposed in proximity to a proximal end of the elongated body. A plurality of conductors is within the elongated body and is electrically connected to corresponding electrical connectors. A distal connector assembly is coupled to the elongated body and includes a rigid holder. A compliant carrier is within the rigid holder, and the compliant carrier defines insulative spacers that form interleaved bays. A plurality of electrical connectors is disposed within the compliant carrier with the electrical connectors being separated by the insulative spacers and being seated within the interleaved bays. The conductors are electrically connected to corresponding electrical connectors within the compliant carrier, and an overmold surrounds the rigid holder, the compliant carrier, and the plurality of spacers and electrical connectors.

Embodiments provide a medical lead extension that includes an elongated body and electrical connectors disposed in proximity to a proximal end of the elongated body. A plurality of conductors is within the elongated body and is electrically connected to corresponding electrical connectors. A distal connector assembly is coupled to the elongated body and includes a rigid holder defines a threaded set screw bore. A plurality of insulative spacers and electrical connectors are disposed within the rigid holder with the electrical connectors being separated by the insulative spacers. The conductors are electrically connected to corresponding electrical connectors within the compliant holder, and an overmold surrounds the rigid holder and the plurality of spacers and electrical connectors.

Embodiments provide a medical lead extension that includes an elongated body and electrical connectors disposed in proximity to a proximal end of the elongated body. A plurality of conductors is within the elongated body and is electrically connected to corresponding electrical connectors. A distal connector assembly is coupled to the elongated body and includes a rigid holder. A set screw block that defines a set screw bore, where the set screw bore is axially aligned with an interior of the rigid holder. A plurality of insulative spacers and electrical connectors are disposed within the rigid holder with the electrical connectors being separated by the insulative spacers. The conductors are electrically connected to corresponding electrical connectors within the compliant holder, and an overmold surrounds the rigid holder and the plurality of spacers and electrical connectors.

Embodiments provide a medical lead extension that includes an elongated body and electrical connectors disposed in proximity to a proximal end of the elongated body. A plurality of conductors is within the elongated body and is electrically connected to corresponding electrical connectors. A distal connector assembly is coupled to the elongated body and includes a rigid holder defining conductor channels. A plurality of insulative spacers and circular electrical connectors are disposed within the rigid holder with the electrical connectors being separated by the insulative spacers. The conductors are routed within the conductor channels and are electrically connected to corresponding electrical connectors within the compliant holder. An overmold surrounds the rigid holder and the plurality of spacers and electrical connectors.

Embodiments provide a method of constructing a distal connector assembly of a medical lead extension. The method involves loading electrical conductors into a compliant carrier that separates the electrical conductors and loading the compliant carrier with the electrical conductors into a rigid holder. The method further involves routing conductors from an elongated cable to the electrical conductors and bonding the conductors to the electrical conductors, and surrounding the rigid holder, compliant holder, and electrical conductors with an overmold.

Embodiments provide a method of constructing a distal connector assembly of a medical lead extension. The method involves loading electrical conductors and individual insulative spacers in an interleaved configuration into a rigid holder. The method further involves routing conductors from an elongated cable to the electrical conductors and bonding the conductors to the electrical conductors, and surrounding the rigid holder, insulative spacers, and electrical conductors with an overmold.

DESCRIPTION OF THE DRAWINGS

FIG. 1I shows an example of a rigid holder that defines a threaded set screw bore.

DETAILED DESCRIPTION

Embodiments provide lead extensions having distal connector assemblies that include rigid holders which provide added structural integrity for the distal connector assembly and resist bending during set screw tightening and/or during anatomical movements. The distal connector assemblies may be constructed in various different manners including placing electrical connectors and insulative spacers within the rigid body or may utilize a compliant carrier for the electrical connectors where the compliant carrier is placed within the rigid holder. Set screw blocks may also be positioned within the rigid holder or within the compliant carrier or may be defined by the rigid holder.

Figure 1:
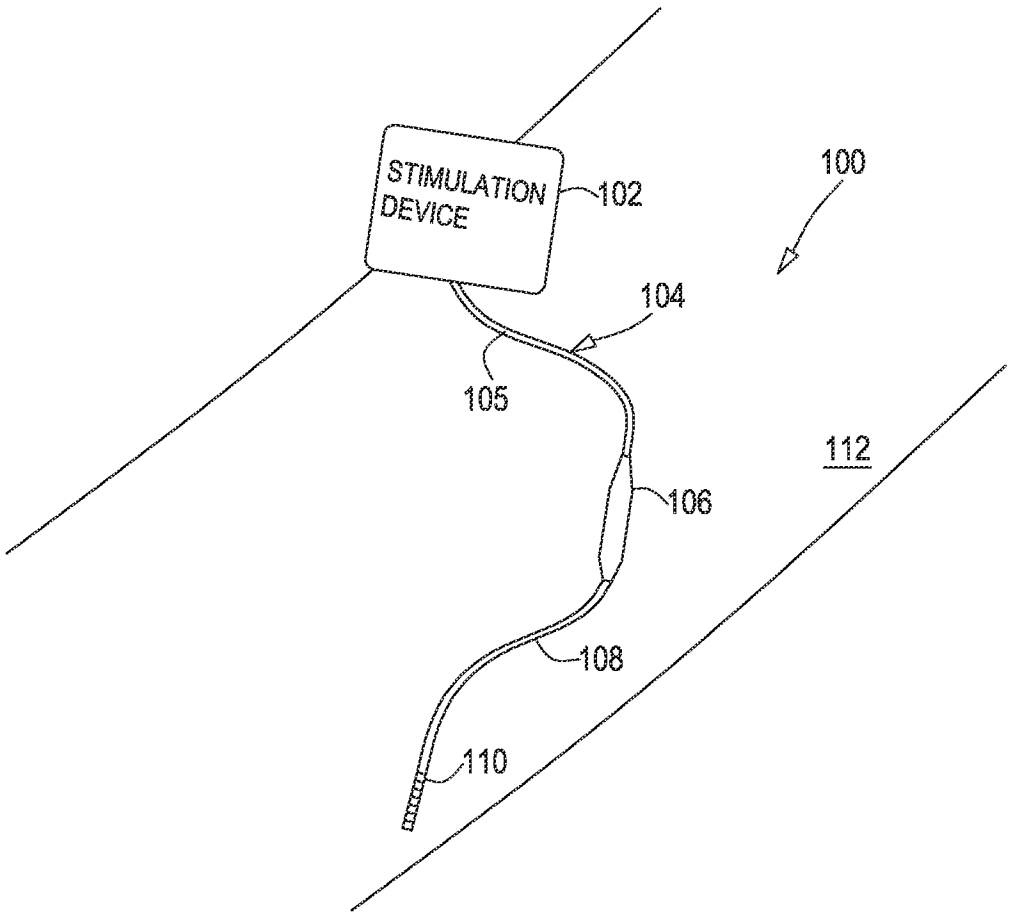
FIG. 1 shows an example of an environment for various embodiments where a medical system is coupled to a patient.

FIG. 1 shows an example of an environment where the various embodiments may be utilized. A medical system 100 is coupled to the body 112 of a patient to provide stimulation therapy. The system 100 includes a stimulation device 102, which may be an external device that is coupled externally to the body 112 such as during a trial period, or an implanted device that is within the body 112. A lead extension 104 which includes an elongated extension portion 105 and a distal connector assembly 106 is coupled to the stimulation device 102 at the proximal end of the extension portion 105. The distal connector assembly 106 is implanted within the body 112, and an implantable lead 108 has a proximal end that is coupled to the distal connector assembly 106. The lead 108 has electrodes 110 on a distal end that are positioned at a stimulation site and that are electrically coupled to the conductors within the lead 108.

The stimulation device 102 produces electrical stimulation signals that are carried by conductors within the lead extension 104. The conductors within the lead extension 104 are electrically coupled to electrical conductors within the lead 108 via the distal connector assembly 106. The electrical stimulation signals pass through the distal connector assembly 106 and through the conductors of the lead 108 until reaching the tissue at the target site via the electrodes 110.

Figure 2:
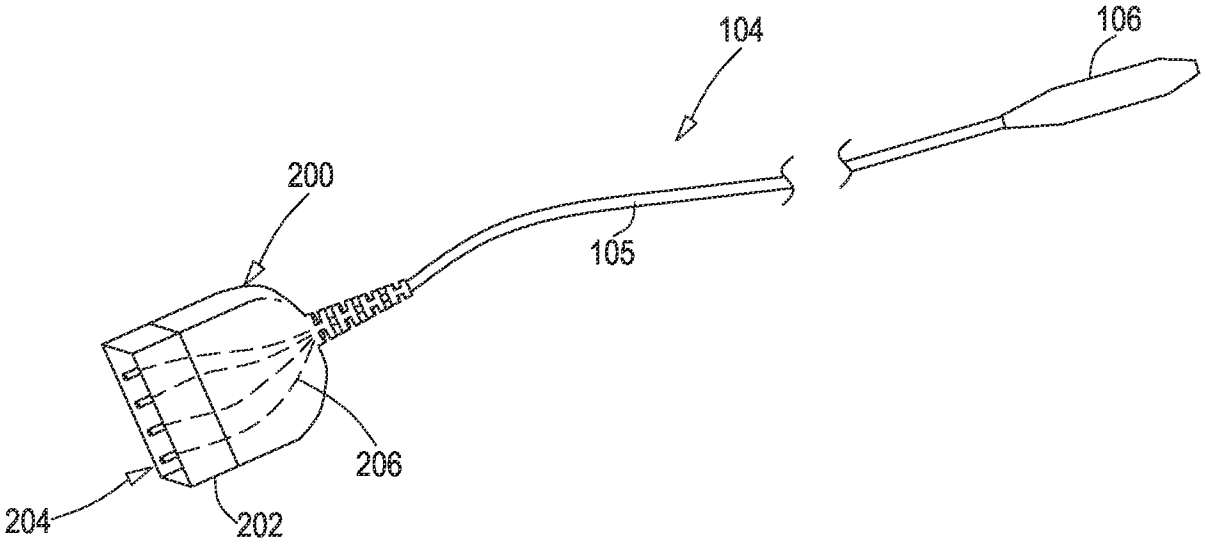
FIG. 2 shows an example of a medical lead extension according to various embodiments.

FIG. 2 shows an example of a lead extension 104 that has a proximal end that remains externally positioned relative to the body 112 and couples to an external stimulation device. A distal end of the lead extension 104 is implanted so that the distal connector assembly 106 receives the proximal end of the implanted lead 108. Examples of the distal connector assembly 106 are discussed in more detail below with reference to FIGS. 3-16.

The proximal end of the lead extension 104 includes a connector body 200 that has a permanent attachment to the lead portion 105 of the lead extension 104. The connector body 200 includes a coupling 202 that interfaces mechanically with a port on the external stimulation device. The connector body 200 is a rigid body sized so that it can be grasped by the physician to plug and unplug the connector body 200 from the external stimulator.

The coupling 202 surrounds electrical connectors 204 that create electrical connections with corresponding connectors of the port on the external stimulation device. The electrical connections 204 of this example are arranged perpendicularly to the longitudinal direction of elongation of the lead portion 105. Conductive conductors 206 extend from within the lead portion 105 to the electrical connections 204 of the connector.

Figure 3:
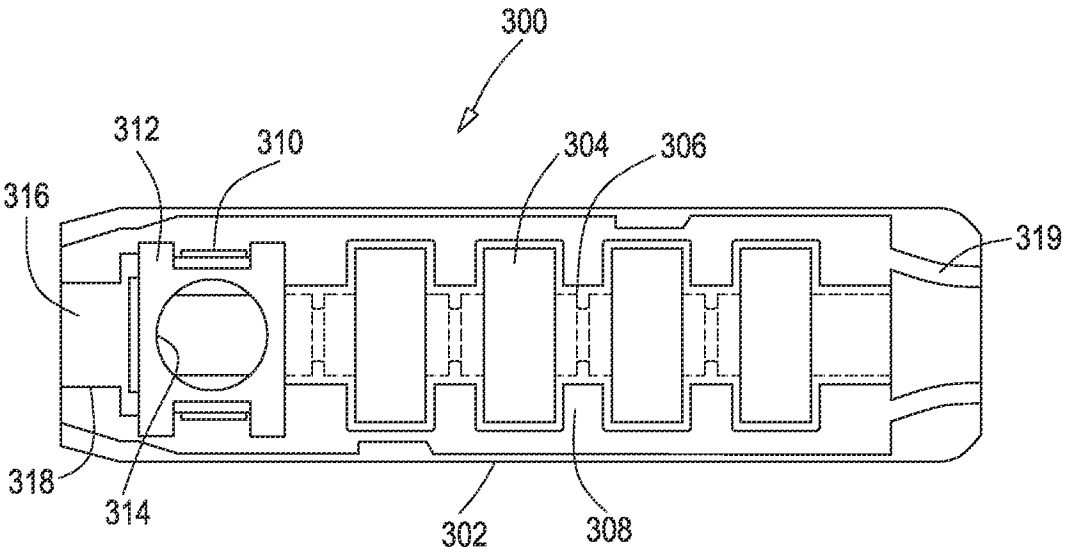
FIG. 3 shows a first example of a distal connector assembly prior to an overmold being applied.
Figure 4:
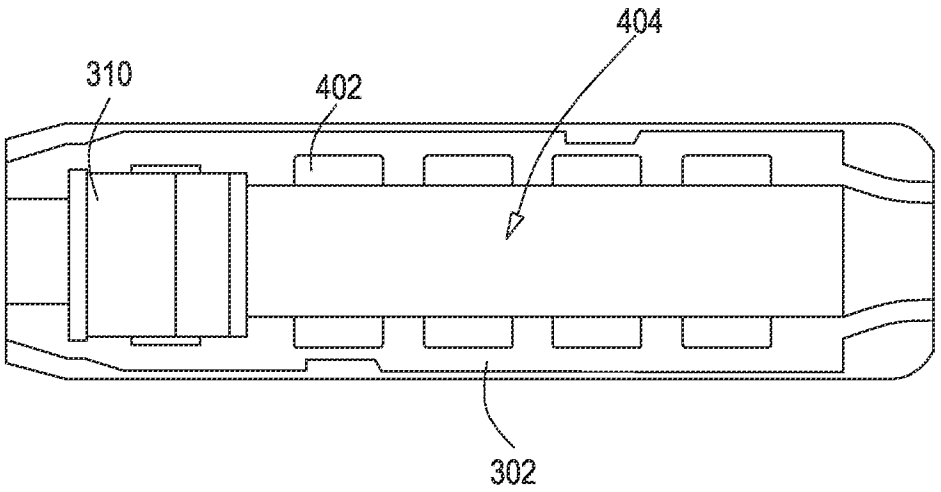
FIG. 4 shows a rigid holder from the distal connector assembly of FIG. 3.

Returning to the distal connector assembly 106 of the extension 104, this assembly 106 may be provided with increased structural integrity so as to avoid bending during the tightening of a set screw by including a rigid holder. FIG. 3 shows a distal connector assembly 300 prior to an overmold being applied. This assembly 300 includes a rigid holder 300 that holds the various components of the assembly 300 in a stacked configuration.

The rigid holder 302 holds electrical connectors 304 that make electrical contact with electrical connectors on the proximal end of the implanted lead 108. In this particular embodiment, the electrical connectors 304 form complete circular structures, examples of which include Bal Seal® canted coil connectors. The electrical connectors 304 are separated from one another by insulative spacers 306 within the rigid holder 302 such that the electrical connectors 304 and insulative spacers 306 are interleaved along the longitudinal axis of the rigid holder 302. The insulative seals 306 may provide wiper seals and may be constructed of a biocompatible compliant material such as silicone. The insulative seals 306 are compressible to some degree in the longitudinal axis of the rigid holder 302 so as to create a tight fit against the adjacent electrical connectors 304.

The rigid holder 302 also includes a bore opening 318 and a set screw block 312 defining a set screw bore 314. The set screw block 312 is seated within the rigid holder 302, such that the set screw bore 314 is axially aligned with an interior of the rigid holder 302 such that the set screw will contact a portion of a lead, such as an electrically active or inactive flanged contact, that is located within the interior of the rigid holder 302. The bore opening 318, a bore opening through the set screw block 312, the electrical connectors 304, and the insulative spacers 306 together form a bore 316 for receiving the proximal end of an implantable lead. The set screw block 312, electrical connectors 304, and insulative spacers 306 may fit tightly within the rigid holder 302 such that the insulative spacers 306 are in a slightly compressed state to maintain seal integrity.

The rigid holder 302 includes additional features as well including a bay 310 that the set screw block 312 fits snugly within. Other features include conductor channels 319 that guide the conductors 206 within the elongated portion 105 of the extension 104. Ridges 308 may be included to retain the electrical connectors 304 within designated bays 402 shown in FIG. 4. A cavity 404 of the rigid holder 402 is also shown where the bays 402 and ridges are located. The cavity 404 results from the semi-circular cross-sectional shape of the rigid holder 302 taken laterally at a longitudinal midpoint.

The rigid holder 302 may be constructed of a biocompatible non-conductive material, such as polyether ether ketone (PEEK). However, for this example where the electrical connector 304 is seated within the bays 402 of the rigid holder 300, the rigid holder is constructed of a material other than PEEK that either bonds well to an overmold such as liquid silicone rubber (LSR), or the PEEK is coated with a material that bonds well to LSR. The over mold is discussed in more detail below with reference to FIG. 9.

Figure 5:
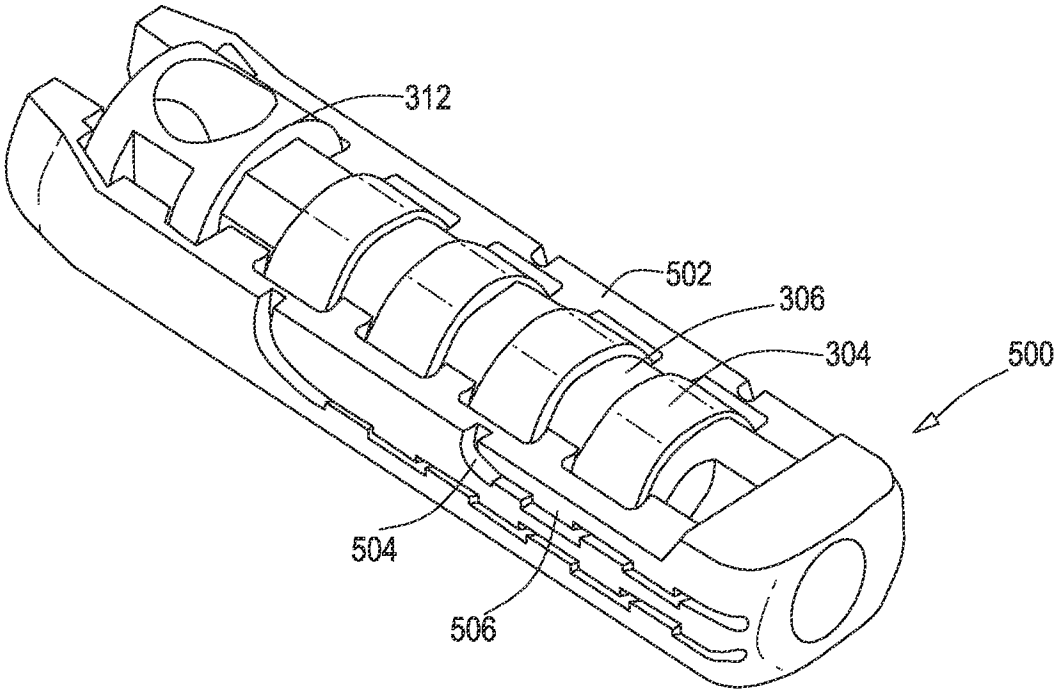
FIG. 5 shows a second example of a distal connector assembly prior to an overmold being applied.

Another example of a distal connector assembly 500 prior to an overmold being applied is shown in FIG. 5. This assembly 500 includes a rigid holder 502 which houses the electrical connectors 304, insulative spacers 306, and set screw block 312 in a stacked configuration. In this example, the rigid holder 502 includes conductor channels 504 along the sides that route the conductors to the electrical connectors 304 with tabs 506 providing an interference fit against the conductors to hold the conductors within the channels 504.

Figure 6:
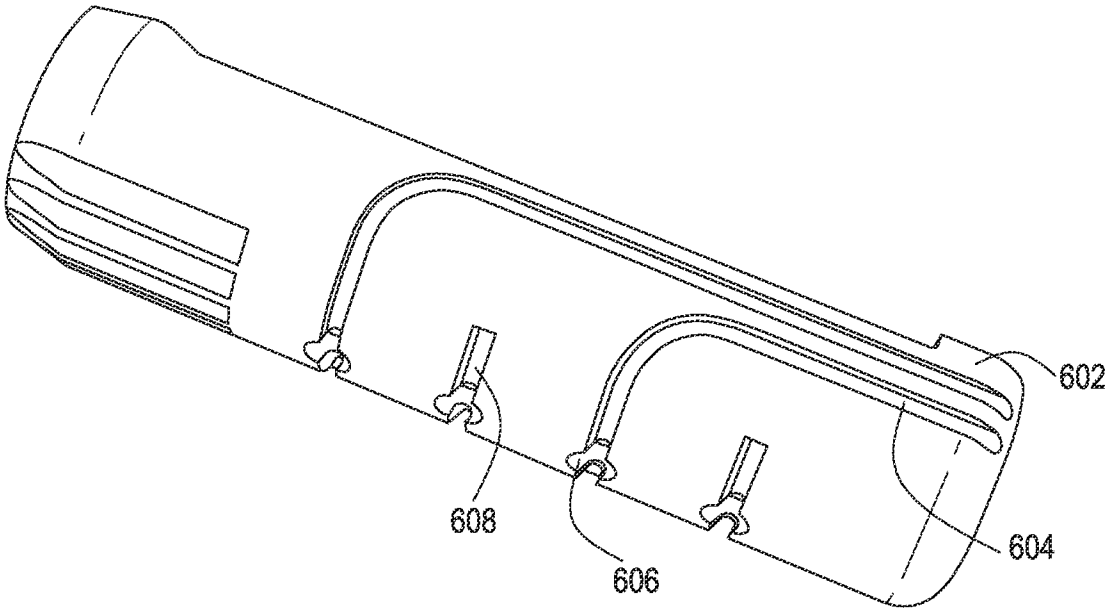
FIG. 6 shows another example of a rigid holder from a distal connector assembly.

FIG. 6 shows another example of a rigid holder 602 with conductor channels 604. The conductor channels 604 route the conductors 206 to openings 606. The openings 606 expose the underside of the electrical connectors 304 to allow the conductors 206 to be electrically coupled to the electrical connectors 304 via a bond, such as one of various types of welds including a resistance spot weld. The conductor channels 608 capture the ends of the conductors that have passed over the openings 606.

Figure 7:
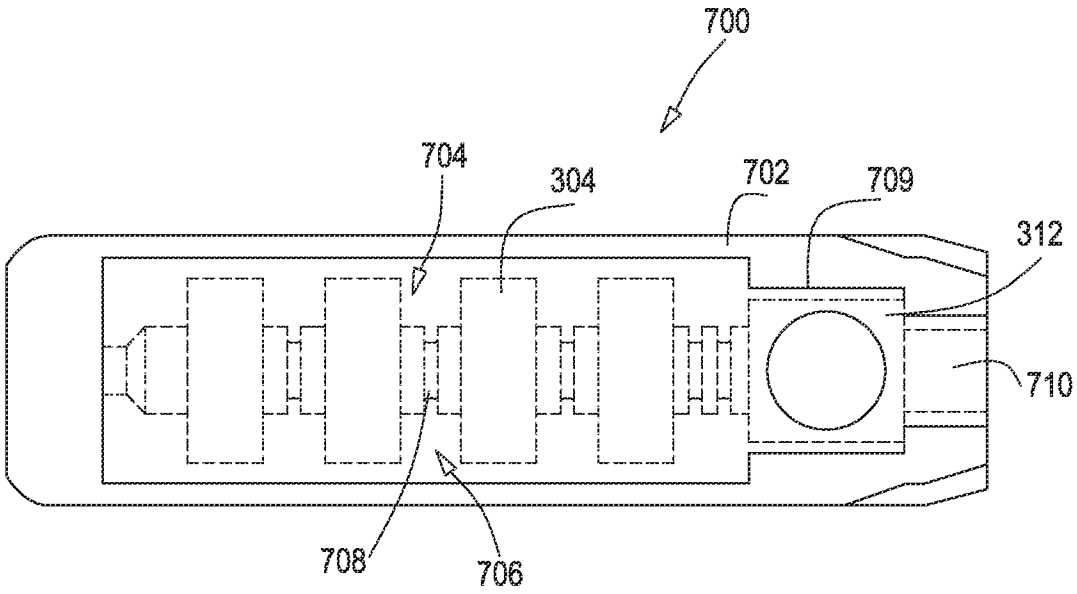
FIG. 7 shows a third example of a distal connector assembly prior to an overmold being applied.
Figure 8:
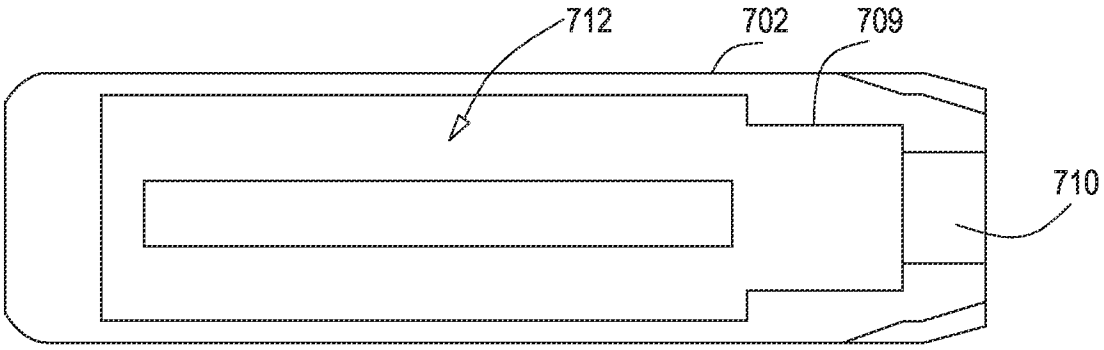
FIG. 8 shows a rigid holder from the distal connector assembly of FIG. 7

FIG. 7 shows another example of a distal end assembly 700 prior to an overmold being applied. In this example, the rigid holder 702 does not have ridges defining individual bays but instead defines one larger cavity 712 as shown in FIG. 8. A compliant carrier 704 constructed of a material such as silicone is positioned within the cavity 712. The individual electrical connectors 304 are positioned within bays that are defined within the compliant carrier 704, with insulative spacers 706 being formed by the silicone carrier 704. The insulative spacers 706 separate the bays and hence the electrical connectors 304 such that the insulative spacers 706 and electrical connectors 304 are interleaved along the longitudinal axis of the rigid holder 702. The insulative spacers 706 also provide wiper seals 708. The underside of the carrier allows the electrical conductors to be exposed for connection to the conductors and for coating by the overmold. Because the compliant carrier 704 separates the electrical conductors from direct contact with the rigid holder 702, the rigid holder 702 may be constructed of a rigid material including PEEK without any coating since adhesion of the LSR to the rigid holder 702 is not a concern.

The cavity 712 of the rigid holder 702 also includes a defined area 709 that holds the portion of the compliant carrier 704 that includes the set screw block 312. A distal opening of the rigid holder 702 together with a bore through the set screw block 312, electrical connectors 304, and insulative spacers 706 of the compliant carrier 704 define a bore 710 where the proximal end of the implantable lead 108 may be received.

Figure 9:
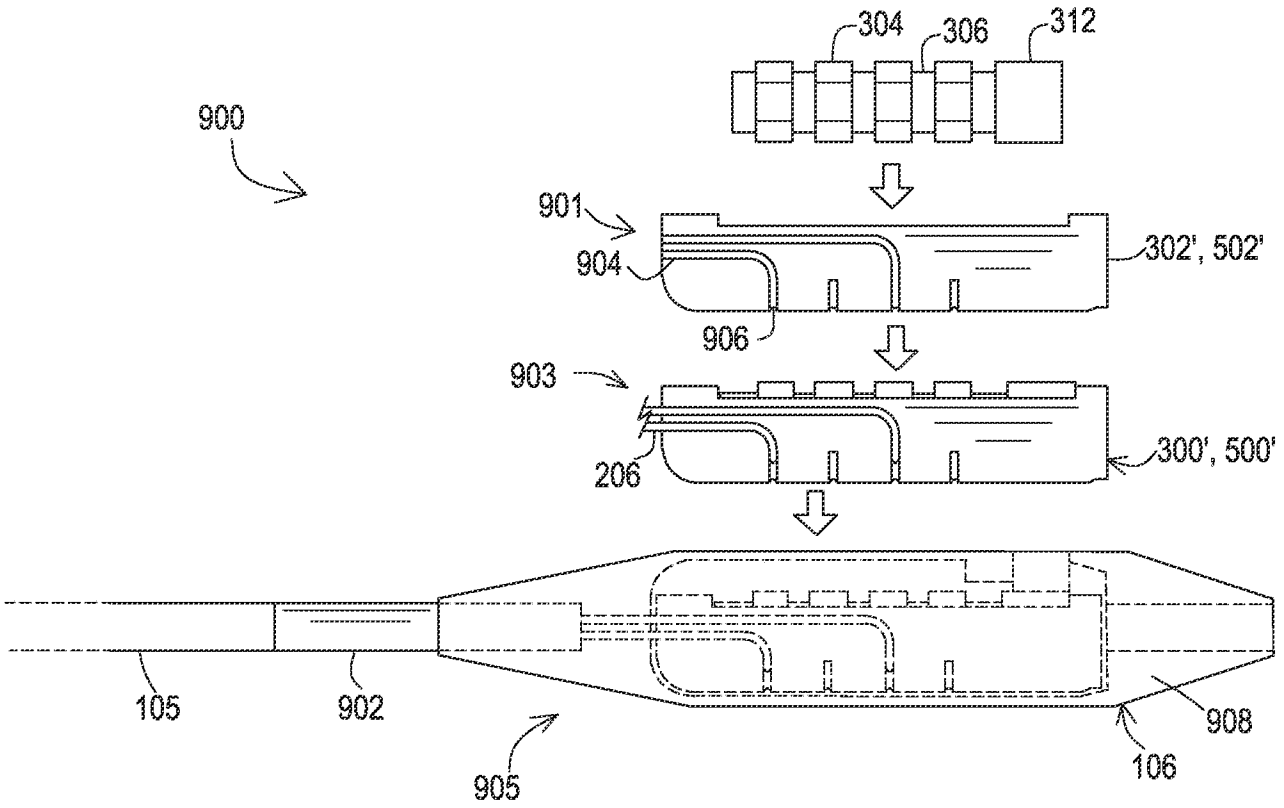
FIG. 9 shows steps of a first example of a manufacturing process to create a distal connector assembly.

FIG. 9 shows an example of manufacturing steps that may be performed to construct a distal connector assembly like the distal connector assemblies 300, 500 but with the overmold included to form the complete distal assembly 106. Initially at a first step 901, the stack configuration of the electrical conductors 304, the insulative spacers 306, and the set screw block 312 are loaded into a rigid holder 302, 502' which in this example has conductor channels 904 and openings 906. As can be seen, the insulative spacers 306 are separate, unitary bodies. The stacked configuration is either loaded onto a molding pin and then placed in the rigid holder 302', 502' or is placed in the rigid holder first and then the molding pin is inserted into the resulting bore.

At a second step 903, the conductors 206 are routed through the conductor channels 904 to the openings 906. A spot weld then bonds the conductors 206 to the corresponding electrical connectors 304. The distal connector assembly 300', 500' only lacks the overmold at this stage. At a third step 905, the overmold 908, such as a layer of LSR that forms the outer shape of the distal connector assembly and provides the final seal for the electrical connectors 304 and set screw block 312, is applied. The overmold 908 effectively surrounds the rigid holder 302', 502', electrical connectors 304, insulative spacers 306, conductors 206, and the set screw block 312. A transition tube 902 has been positioned over the distal end of the portion 105 that houses the several conductors 206 prior to the conductors having been welded in step 903. The overmold 908 laps over the ends of the transition tube 902. The complete distal connector assembly 106 is ready for implantation.

Figure 10:
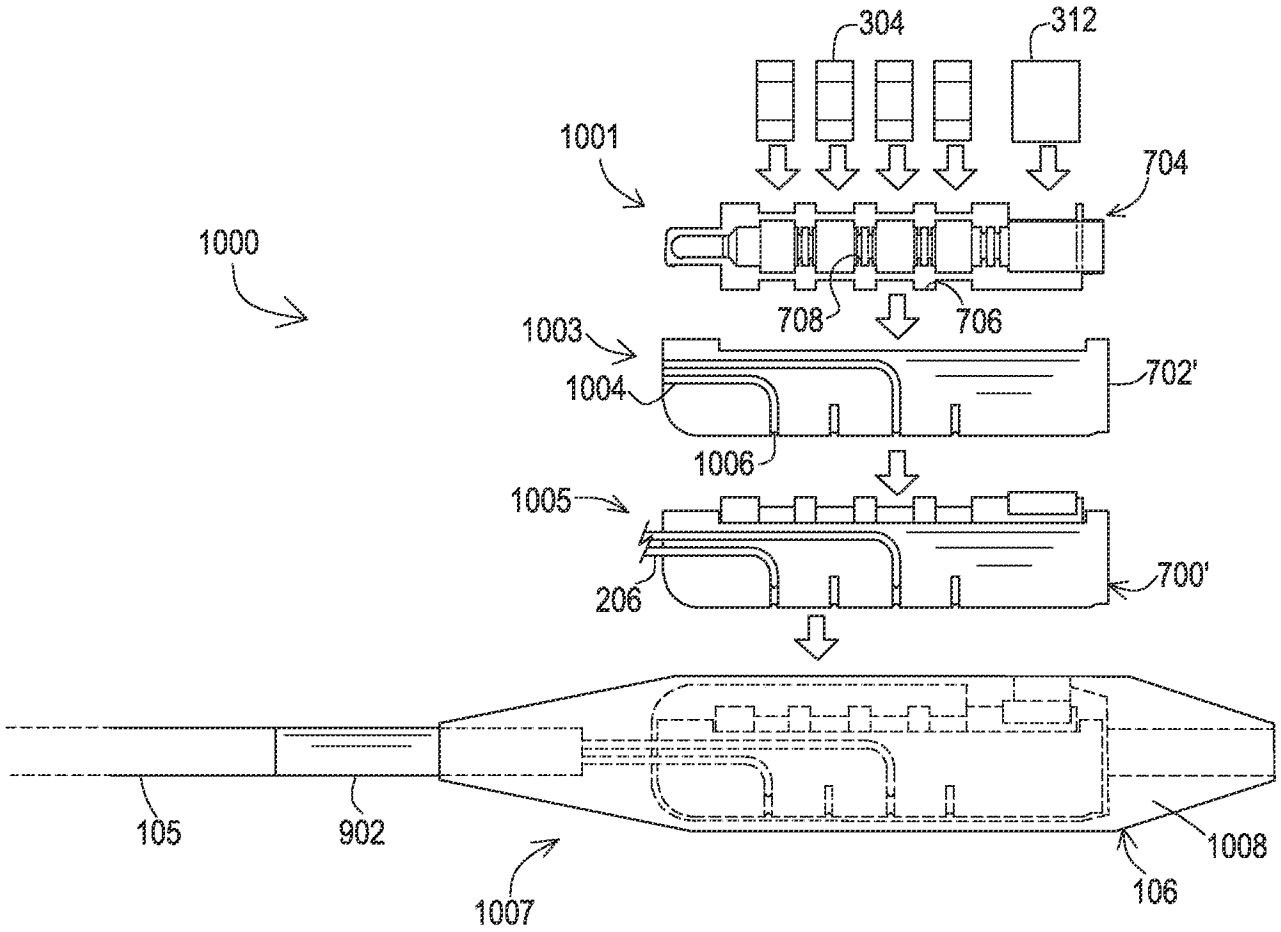
FIG. 10 shows steps of a second example of a manufacturing process to create a distal connector assembly.

FIG. 10 shows an example of the manufacturing steps that may be performed to construct a distal connector assembly like the distal connector assembly 700 but with the overmold included to form the completed distal assembly 106. Initially at a first step 1001, the stacked configuration of the electrical conductors 304 and the set screw block 312 are loaded into a compliant carrier 704 which in this example has integral insulative spacers 706 defining bays for the electrical connectors 304 and also defining wiper seals 708.

In the second step 1003, the compliant carrier 704 is loaded into the rigid holder 702' which in this example has conductor channels 1004 and openings 1006. The stacked configuration within the compliant carrier 704 is either loaded onto a molding pin and then placed in the rigid holder 702' or the stacked configuration within the compliant carrier 704 is placed in the rigid holder 702' first and then the molding pin is inserted into the resulting bore.

At a third step 1005, the conductors 206 are routed through the conductor channels 1004 to the openings 1006. A spot weld then bonds the conductors 206 to the corresponding electrical connectors 304. The distal connector assembly 700' only lacks the overmold at this stage. At a fourth step 1007, the overmold 1008, such as a layer of LSR that forms the outer shape of the distal connector assembly and provides the final seal for the electrical connectors 304 and set screw block 312, is applied. The overmold 1008 effectively surrounds the rigid holder 702', electrical connectors 304, carrier 704, conductors 206, and set screw block 312. The transition tube 902 has been positioned over the distal end of the portion 105 that houses the several conductors 206 prior to the conductors having been welded in step 1005. The overmold 1008 laps over the ends of the transition tube 902. The complete distal connector assembly 106 is ready for implantation.

Figure 11:
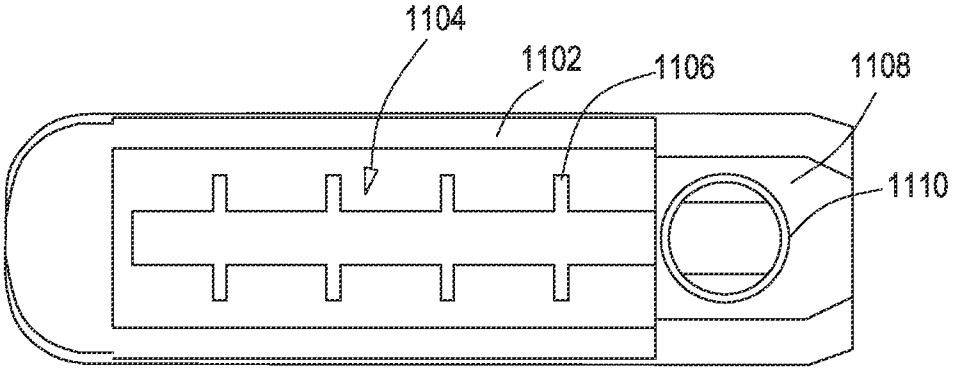
Figure 12:
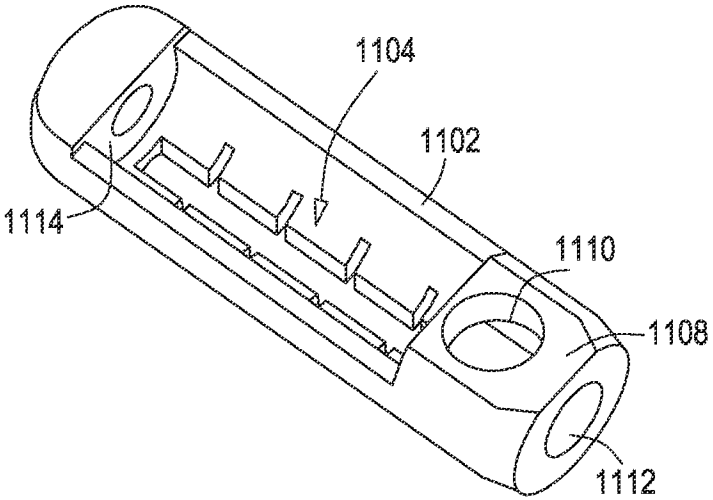
FIG. 12 shows a perspective view of the rigid holder of FIG. 11.

FIGS. 11 and 12 show an example of another alternative rigid holder 1102 constructed of a rigid material such as PEEK. In this example, the rigid holder 1102 has a cavity 1104 for holding a compliant carrier with insulative spacers and with the electrical connectors 304. Openings 1106 are provided for access to the electrical connectors 304 during bonding of the conductors. However, the rigid holder 1102 also includes an integral portion 1108 defining a set screw bore 1110 for receiving a set screw. The bore 1110 may be threaded so that the set screw threads directly engage and tighten against the set screw bore 1110. As shown in FIG. 12, the integral portion 1108 further defines the opening to the bore 1112.

The presence of the integral portion 1108 prevents a molding pin from being dropped into the cavity 1104. Therefore, the compliant carrier and electrical connectors 304, or in the individual insulative spacers and electrical connectors 304, are placed in the cavity and the molding pin is inserted longitudinally into the bore 1112. A proximal end bore opening 1114, which may be included in all rigid holder embodiments discussed herein, receives a tip of the molding pin during manufacturing.

Figure 13:
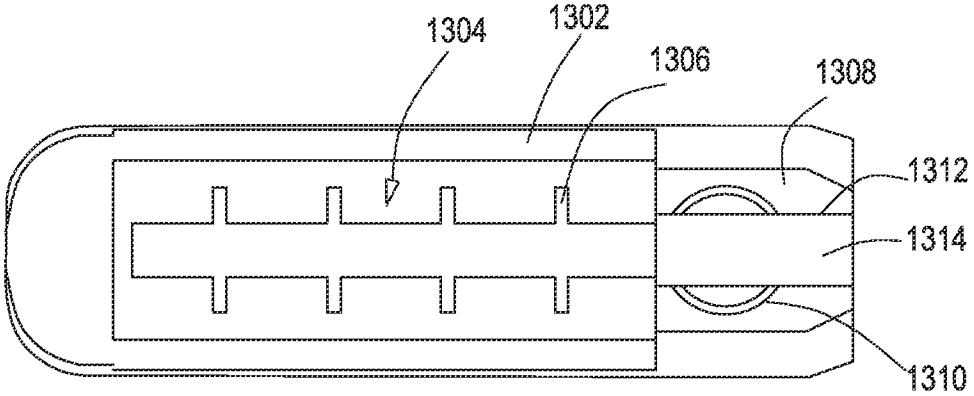
FIG. 13 shows another example of a rigid holder that defines a threaded set screw bore.
Figure 14:
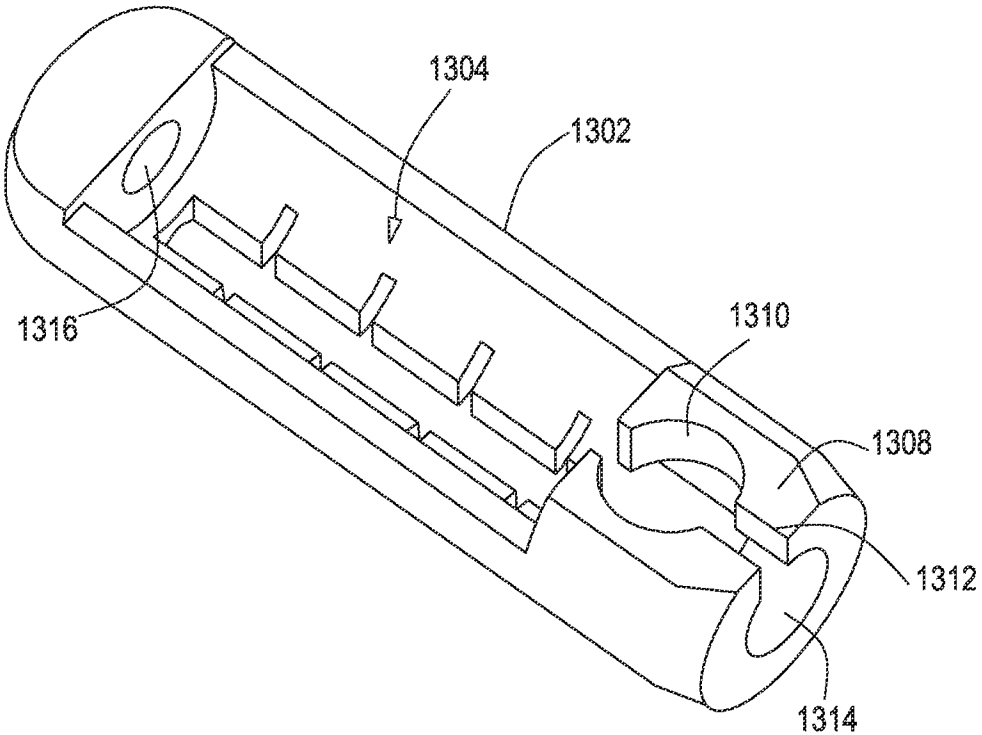
FIG. 14 shows a perspective view of the rigid holder of FIG. 13.

FIGS. 13 and 14 show another example of an alternative rigid holder 1302 constructed of a rigid material such as PEEK. In this example, the rigid holder 1302 has a cavity 1304 for holding a compliant carrier with insulative spacers and with the electrical connectors 304. Openings 1306 are provided for access to the electrical connectors 304 during bonding of the conductors. However, the rigid holder 1302 also defines an integral portion 1308 defining a set screw bore 1310 for receiving a set screw. The bore 1310 may be threaded so that the set screw threads directly engage and tighten against the set screw bore 1310.

In this example, the integral portion 1308 also includes a slot 1312 in the longitudinal axis of the rigid holder 1302 and aligned with an opening to the bore 1314. The slot 1312 allows a molding pin to be dropped into the bore 1314 rather than inserted longitudinally into the bore 1314. Thus, the molding pin may be pre-loaded with the compliant carrier and electrical connectors 304 or the individual insulative spacers and electrical connectors 304 and then placed into the cavity 1304. A proximal end bore opening 1316 receives a tip of the molding pin during manufacturing.

Figure 15:
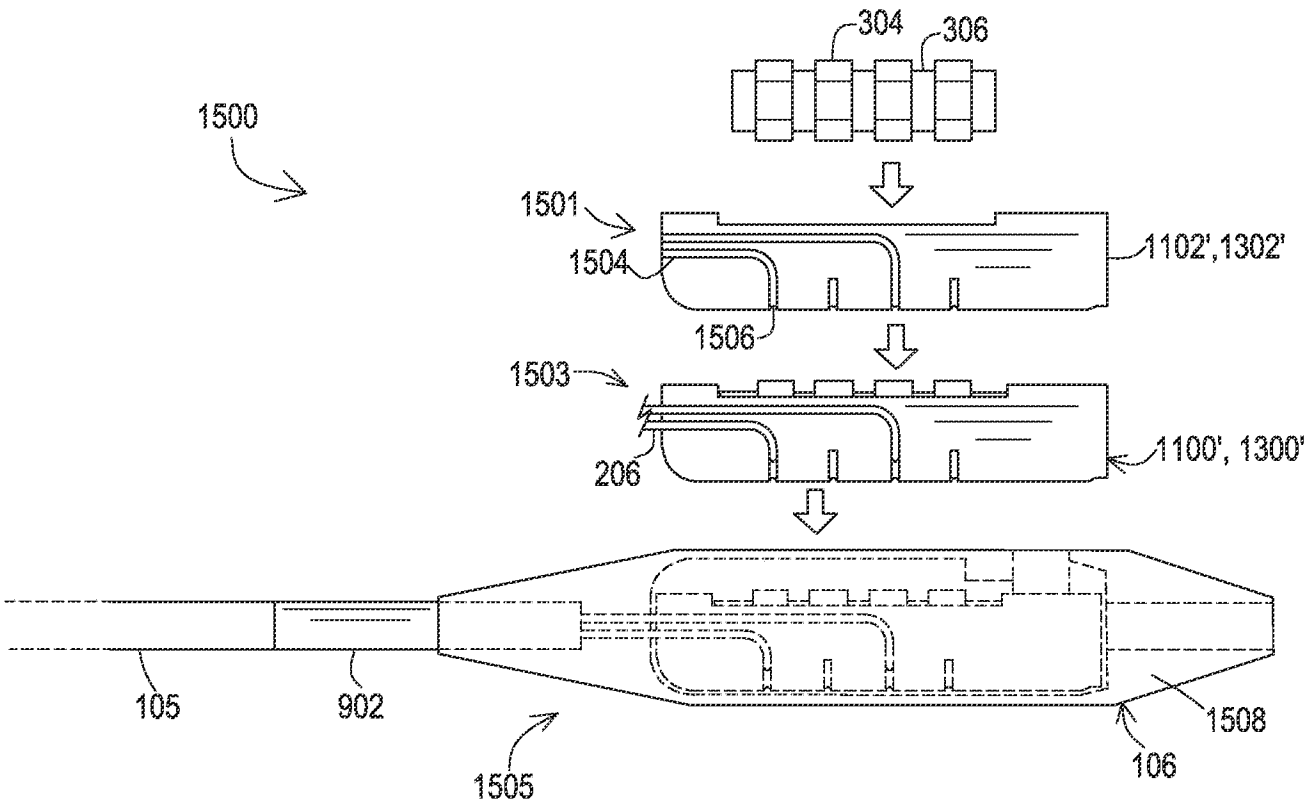
FIG. 15 shows steps of a third example of a manufacturing process to create a distal connector assembly.

FIG. 15 shows an example of the manufacturing steps that may be performed to construct a distal connector assembly that utilizes rigid holders with integrated portion defining a set screw bore like the rigid holders 1102, 1302. Initially at a first step 1501, the stacked configuration of the electrical conductors 304 and the insulative spacers 306 are loaded into a rigid holder 1102', 1302' which in this example has conductor channels 1504 and openings 1506. As can be seen, the insulative spacers 306 are separate, unitary bodies. For a rigid holder 1302' that has a slot through the integral portion defining the set screw bore, the stacked configuration is placed onto a molding pin and then placed in the rigid holder 1302'. For a rigid holder 1102' that does not have a slot through the integral portion defining the set screw bore, the stacked configuration is placed in the rigid holder 1102' first and then the molding pin is inserted into the resulting bore.

At a second step 1503, the conductors 206 are routed through the conductor channels 1504 to the openings 1506.

A spot weld then bonds the conductors 206 to the corresponding electrical connectors 304. The distal connector assembly 1100' with rigid holder 1102', or assembly 1300' with rigid holder 1302' only lacks the overmold at this stage. At a third step 1505, the overmold 1508, such as a layer of LSR that forms the outer shape of the distal connector assembly and provides the final seal for the electrical connectors 304, is applied. The overmold 1508 effectively surrounds the rigid holder 1302', 1502', electrical connectors 304, insulative spacers 306, and conductors 206. A transition tube 902 has been positioned over the distal end of the portion 105 that houses the several conductors 206 prior to the conductors having been welded in step 1503. The overmold 1508 laps over the ends of the transition tube 902. The complete distal connector assembly 106 is ready for implantation.

Figure 16:
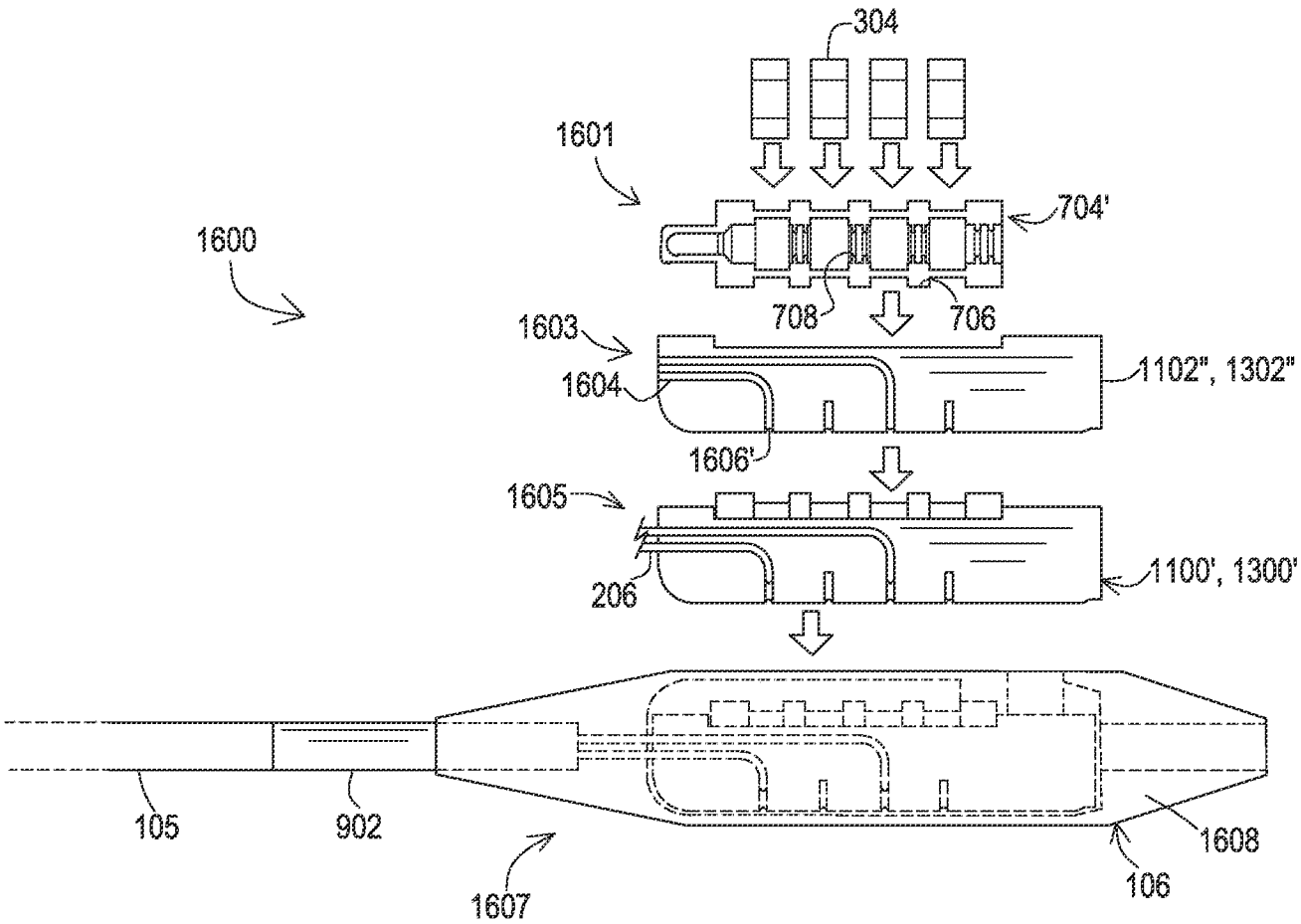
FIG. 16 shows steps of a fourth example of a manufacturing process to create a distal connector assembly.

FIG. 16 shows an example of the manufacturing steps that may be performed to construct a distal connector assembly like the distal connector assembly 700 but with the overmold included to form the completed distal assembly 106. Initially at a first step 1601, the stacked configuration of the electrical conductors 304 are loaded into a compliant carrier 704' which in this example has integral insulative spacers 706 defining bays for the electrical connectors 304 and also defining wiper seals 708 but lacks a bay for a set screw block.

In the second step 1603, the compliant carrier 704' is loaded into the rigid holder 1102", 1302" which in this example has conductor channels 1604 and openings 1606. The stacked configuration within the compliant carrier 704' is loaded onto a molding pin and then placed in the rigid holder 1302' having the slot through the integral portion defining the set screw bore. Alternatively, the stacked configuration within the compliant carrier 704' is first placed in the rigid holder 1102" which lacks the slot through the integral portion defining the set screw bore and then the molding pin is inserted into the resulting bore.

At a third step 1605, the conductors 206 are routed through the conductor channels 1604 to the openings 1606. A spot weld then bonds the conductors 206 to the corresponding electrical connectors 304. The distal connector assembly 1100' or 1300' only lacks the overmold at this stage. At a fourth step 1607, the overmold 1608, such as a layer of LSR that forms the outer shape of the distal connector assembly and provides the final seal for the electrical connectors 304, is applied. The overmold 1608 effectively surrounds the rigid holder 1102", 1302", electrical connectors 304, carrier 704', and conductors 206. The transition tube 902 has been positioned over the distal end of the portion 105 that houses the several conductors 206 prior to the conductors having been welded in step 1605. The overmold 1608 laps over the ends of the transition tube 902. The complete distal connector assembly 106 is ready for implantation.

While embodiments have been particularly shown and described, it will be understood by those skilled in the art that various other changes in the form and details may be made therein without departing from the spirit and scope of the invention.

What is claimed is:

1. A method of constructing a system including a medical lead and a medical lead extension with a distal connector assembly, comprising:

providing a carrier containing a plurality of electrical connectors loaded into a holder;

providing conductors routed from an elongated cable to the electrical connectors and electrically coupled to the electrical connectors;

providing the holder, carrier, and electrical connectors within an enclosure that forms the distal connector assembly; and inserting a proximal end of a lead into the distal connector assembly.

2. The method of claim 1, further comprising providing a set screw block loaded into the carrier prior to loading the carrier into the holder.

3. The method of claim 1, further comprising providing the electrical connectors loaded into the carrier that separates the electrical connectors.

4. The method of claim 3, wherein the holder defines a threaded set screw bore and wherein the carrier is positioned adjacent to a portion of the holder that defines the set screw bore.

5. The method of claim 1, wherein the carrier is compliant.

6. The method of claim 1, wherein the holder is rigid.

7. The method of claim 1, wherein providing the holder, carrier, and electrical connectors within an enclosure comprises providing the holder, carrier, and electrical connectors within an overmold.

8. A system including a medical lead and a medical lead extension, comprising:

a proximal connector of the medical lead extension;

an elongated cable of the medical lead extension that contains a plurality of electrical conductors, the elongated cable having a distal end and having a proximal end that is coupled to the proximal connector;

a distal connector that is coupled to the distal end of the elongated cable, the distal connector comprising:

a holder;

a carrier containing a plurality of electrical connectors loaded into the holder, wherein the plurality of electrical conductors are routed from the elongated cable to the electrical connectors and are electrically coupled to the electrical connectors; and an enclosure surrounding the holder, carrier, and electrical connectors; and a medical lead having a proximal end inserted into the distal connector.

9. The system of claim 8, further comprising a set screw block loaded into the carrier.

10. The system of claim 8, wherein the carrier separates the electrical connectors.

11. The system of claim 8, wherein the holder defines a threaded set screw bore and wherein the carrier is positioned adjacent to a portion of the holder that defines the set screw bore.

12. The system of claim 8, wherein the carrier is compliant.

13. The system of claim 8, wherein the holder is rigid.

14. The system of claim 8, wherein the enclosure comprises an overmold.

15. A method of constructing a system that includes a medical lead and a medical lead extension having a distal connector assembly, comprising:

providing a carrier, a plurality of electrical connectors, and a holder combined such that the electrical connectors are present within the carrier and the carrier is present within the holder;

providing conductors routed from an elongated cable to the electrical connectors and electrically coupled to the electrical connectors;

providing the holder, carrier, and electrical connectors within an enclosure that forms the distal connector assembly; and inserting a proximal end of the medical lead into the distal connector assembly.

16. The method of claim 15 further comprising providing a set screw block loaded into the carrier.

17. The method of claim 15, wherein the holder defines a threaded set screw bore and the method further comprises providing the carrier in a position adjacent to a portion of the holder that defines the set screw bore.

18. The method of claim 15, wherein the carrier is compliant.

19. The method of claim 15, wherein the holder is rigid.

20. The method of claim 15, wherein providing the holder, carrier, and electrical connectors within an enclosure comprises providing the holder, carrier, and electrical connectors within an overmold.

21. A medical lead extension, comprising:

a proximal connector;

an elongated cable containing a plurality of electrical conductors, the elongated cable having a distal end and having a proximal end with the proximal connector at the proximal end, the electrical conductors including a distal portion that extends beyond the distal end of the elongated cable;

a distal connector that is coupled to the distal end of the elongated cable, the distal connector comprising:

a holder;

a carrier containing a plurality of electrical connectors loaded into the holder wherein the distal portions of the plurality of electrical conductors are routed from the elongated cable to the electrical connectors and are electrically coupled to the electrical connectors; and an enclosure surrounding the holder, carrier, and electrical connectors.

22. The medical lead extension of claim 21, wherein the distal connector is configured to receive at least a portion of a medical lead.

23. The medical lead extension of claim 21, where the portion of the medical lead electrically couples with at least one electrical conductor.

24. The medical lead extension of claim 21, further comprising a set screw block loaded into the carrier.

25. The medical lead extension of claim 21, wherein the carrier separates the electrical connectors.

26. The medical lead extension of claim 21, wherein the holder defines a threaded set screw bore and wherein the carrier is positioned adjacent to a portion of the holder that defines the set screw bore.

27. The medical lead extension of claim 21, wherein the carrier is compliant.

28. The medical lead extension of claim 21, wherein the holder is rigid.

29. The medical lead extension of claim 21, wherein the enclosure comprises an overmold.

* * * * *